US007043041B2

(12) United States Patent
Švajda et al.

(10) Patent No.: US 7,043,041 B2
(45) Date of Patent: May 9, 2006

(54) INTEGRATED TELECOIL AMPLIFIER WITH SIGNAL PROCESSING

(75) Inventors: Miroslav Švajda, Saratoga, CA (US); Alwin Fransen, Px Delft (NL)

(73) Assignee: SonionMicrotronic Nederland B.V., Amsterdam (NL)

( * ) Notice: Subject to any disclaimer, the term of this patent is extended or adjusted under 35 U.S.C. 154(b) by 408 days.

(21) Appl. No.: 09/970,399

(22) Filed: Oct. 3, 2001

(65) Prior Publication Data

US 2002/0039428 A1 Apr. 4, 2002

Related U.S. Application Data

(60) Provisional application No. 60/237,914, filed on Oct. 4, 2000.

(51) Int. Cl.
*H04R 25/00* (2006.01)

(52) U.S. Cl. ..... 381/331; 381/323; 381/312; 381/316

(58) Field of Classification Search ..... 381/312, 381/314–316, 328, 326, 331, 380, 60, 323, 381/384; 379/430, 443; 600/25
See application file for complete search history.

(56) References Cited

U.S. PATENT DOCUMENTS

| | | | | |
|---|---|---|---|---|
| 3,659,056 | A * | 4/1972 | Morrison et al. | 381/315 |
| 4,606,329 | A * | 8/1986 | Hough | 600/25 |
| 4,790,019 | A | 12/1988 | Hueber | 381/68.4 |
| 4,845,755 | A | 7/1989 | Busch et al. | 381/68 |
| 5,086,464 | A * | 2/1992 | Groppe | 379/340 |
| 5,217,011 | A * | 6/1993 | Bisch | 607/51 |
| 6,044,162 | A * | 3/2000 | Mead et al. | 381/312 |
| 6,078,675 | A * | 6/2000 | Bowen-Nielsen et al. | 381/331 |
| 6,115,478 | A * | 9/2000 | Schneider | 381/315 |
| 6,157,728 | A * | 12/2000 | Tong et al. | 381/331 |
| 6,603,860 | B1 * | 8/2003 | Taenzer et al. | 381/312 |

FOREIGN PATENT DOCUMENTS

| | | |
|---|---|---|
| CH | 670 349 A5 | 5/1989 |
| DK | 97 00318 U3 | 9/1997 |

* cited by examiner

*Primary Examiner*—Suhan Ni
(74) *Attorney, Agent, or Firm*—Jenkens & Gilchrist

(57) ABSTRACT

The invention concerns a method of receiving and processing both audio and non-audio signals for use in a hearing aid or other listening device comprising converting electromagnetic radiation to electrical signals, amplifying said electrical signals to produce amplified signals, and filtering the amplified signals in an audio frequency range. The invention extends to a novel integrated amplified telecoil system for carrying out the method.

31 Claims, 3 Drawing Sheets

INTEGRATED TELECOIL AMPLIFIER WITH SIGNAL PROCESSING

RELATED APPLICATION

This application claims the benefit of priority of U.S. Provisional Patent Application No. 60/237,914, filed Oct. 4, 2000.

FIELD OF THE INVENTION

The present invention relates generally to telecoils and, more particularly, to the use of an integrated amplifier with the telecoil to provide signal processing that shapes the telecoil transfer function in the audio frequency signal range.

BACKGROUND OF THE INVENTION

A conventional hearing aid or listening device can include both a microphone and a telecoil. The microphone picks up acoustic sound waves and converts the acoustic sound waves to an electrical signal. That signal is then processed (e.g., amplified) and sent to the speaker (or "receiver") of the hearing aid. The speaker then converts the amplified signal to an acoustic signal that is broadcast towards the eardrum.

On the other hand, the telecoil picks up electromagnetic signals. The telecoil for a hearing aid is a small electromagnetic induction coil, such as a wire wound around a magnetic bobbin. The telecoil produces a voltage over its terminals when placed within an electromagnetic field, which is created by an alternating current of an audio signal moving through a wire. When the telecoil is placed near the wire carrying the current of the audio signal, an equivalent audio signal is induced in the telecoil. The signal in the telecoil is then amplified and sent to the speaker (or "receiver") of the hearing aid for conversion to an acoustic signal.

The telecoil can be used in connection with a telephone. The telephone headset includes speakers with induction coils. If an individual places the hearing aid with the telecoil adjacent the telephone headset, an alternating current in the induction coils of the telephone speakers creates an electromagnetic field that induces an audio signal in the telecoil. The signal of the telecoil is amplified and sent to the speaker of the hearing aid. Thus, the individual receives the telephone conversation without any background audio noises.

Another use of the telecoil is to receive the sound that is passed into a microphone used by a speaker in a large room, such as a church or auditorium. The microphone, of course, sends the audio signal to loudspeakers which convert the audio signal to an acoustic signal. But, the audio signal may also pass through an induction loop around the room and create a magnetic induction field. The telecoil picks up the magnetic field and, thus, the person wearing the hearing aid can hear the speaker without the common background audio noises that may occur in a church or auditorium.

In addition to receiving the audio frequency magnetic signal from induction loops (referred to as low frequency signals—LF telecoils), the telecoil of a hearing aid may receive modulated/RF electromagnetic signals from a remote control device or programming equipment (referred to as high-frequency—HF telecoils). Thus, the HF signal may be used to control the operation of the hearing aid or to program the hearing aid. Because of the different demands on the properties of the telecoil for receiving LF and HF signals (e.g., response curve, Q, losses, size, wire diameter, etc.), there are typically two induction telecoils (i.e., HF and LF telecoils) presently used in hearing aids when both functions are required.

The current LF telecoils having integral amplifiers ("amplified telecoils") use the amplifier in a feedback configuration that is provided by internal or external feedback devices, which forms a low-impedance current input for the telecoil as shown in FIG. 1. The frequency response from the source, $e_{oc}$, is then a low-pass response and is mainly determined by telecoil parameters (e.g., inductance $L_c$, resistance $R_c$). The result is the desired, relatively flat frequency response from the inductive transmitting source to the output of the amplified telecoil (i.e., "telecoil transfer function") in the operating audio frequency signal range of approximately 20 Hz to 10 kHz. Because the characteristic frequency response and gain of the telecoil transfer function depend on the same telecoil parameters (i.e., inductance $L_c$ and resistance $R_c$ of FIG. 1), it is difficult to set both the desired gain and the desired frequency response of the amplified telecoil system at the same time.

SUMMARY OF THE INVENTION

The integrated telecoil amplifier (or integral amplifier) of the present invention is an active device (or several active devices) providing signal processing of the signals received by the telecoil. This processing is performed in the amplified telecoil system between the telecoil and an output. Output signals from other transducers (e.g., microphones, external signal source, etc.) may be processed in the same manner. Such output signals from transducers (e.g., amplified telecoil, microphones) can be combined by a mixing device or may enter the signal processor directly. In one embodiment, the present invention uses an integrated telecoil amplifier with high impedance input to which the telecoil is coupled. To ensure correct frequency shaping, the invention uses internal filters having frequency characteristics not influenced by any telecoil property in the integrated telecoil amplifier. Accordingly, the frequency response of the amplified telecoil system can be shaped as a whole, independent of the telecoil properties.

Further, the integrated telecoil amplifier of the present invention can be used for the simultaneous reception of signals in the audio frequency range (e.g., 20 Hz to 10 kHz) and signals outside this audio frequency range by means of the frequency spectrum separation provided by internal LF and HF filters. As a result, the integrated telecoil amplifier of the present invention makes it possible to simultaneously receive and process both audio signals and other signals using the same telecoil.

In accordance with one aspect of the present invention, an integrated amplified telecoil system comprises a telecoil which produces an electrical output signal in response to electromagnetic radiation, a first amplifier having an input coupled to the telecoil, and a first amplifier output. The telecoil system further includes a filter having a selected pass band in an audio frequency range. The filter has an input coupled to the first amplifier output and an output.

In accordance with another aspect of the invention, a method of receiving and processing audio and non-audio signals for use in a hearing aid comprises converting electromagnetic radiation to electrical signals, amplifying the electrical signals to produce amplified signals, and signal processing of the amplified signals. Circuitry for performing the method can be integrated on a single integrated circuit (IC) or a hybrid. The hybrid may consist of one or more IC's and discrete components placed on a common miniature device that fits within a hearing aid.

BRIEF DESCRIPTION OF THE DRAWINGS

The foregoing and other advantages of the invention will become apparent upon reading the following detailed description and upon reference to the drawings.

Figure 1:
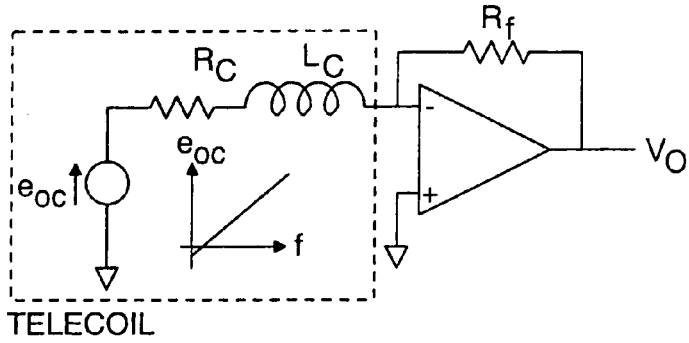
Fig. 1 Prior Art
FIG. 1 is a schematic of a typical prior art telecoil having an amplifier.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

Figure 2:
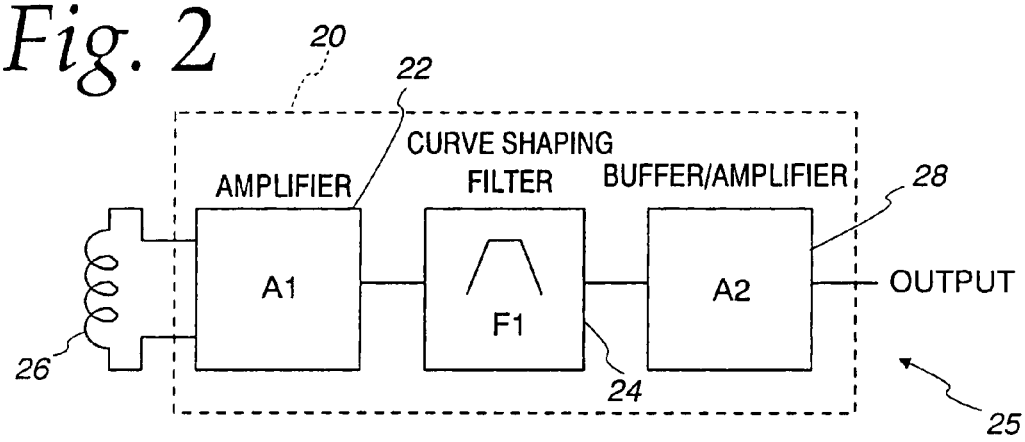
FIG. 2 is a schematic of an integrated amplified telecoil system in accordance with the invention.

Referring to FIG. 2, the integrated telecoil amplifier 20 provides internal signal processing which shapes the telecoil transfer function in the operating audio frequency signal range (approximately 20 Hz to 10 kHz) independently of telecoil properties (e.g., inductance $L_c$, resistance $R_c$). Thus, only the sensitivity of the telecoil affects the overall sensitivity of the amplified telecoil system.

Using the high input impedance voltage amplifier 22 together with a filter 24, which provides response curve shaping, any inductive telecoil 26 can be coupled to the input of such an integrated telecoil amplifier 20 without modifying the frequency response of the amplified telecoil system 25 in the audio frequency range. The desired frequency response is set by the filter 24 and does not depend on coil parameters.

It should be noted that any non-linearity in the response of the telecoil 26 in the frequency bands of interest (e.g., when the resonance frequency of the telecoil falls within these bands) will influence the frequency response of the complete system. This will not influence the frequency response of the internal filters, however, and it does not further limit the usefulness of this invention.

A second amplifier 28 coupled to the filter 24 serves as an additional amplifier and/or buffer for the filter 24. The second amplifier 28 also acts as an interface of the integrated telecoil amplifier 20 to the following circuitry in the hearing aid. The telecoil 26 can be coupled to the amplifier 22 differentially or single-ended, and/or the amplifier 22 attached to the telecoil 26 can be single-ended or differential or any combination of these. Also, electromagnetic interference (EMI) and/or electrostatic discharge (ESD) protection circuitry (on-chip or off-chip) can be used at inputs and/or outputs of the integrated telecoil amplifier 20.

It should be noted that the first amplifier 22 attached to the telecoil 26 may contain additional capacitive feedback to the input, which sets a desired bandwidth of the first amplifier 22. Limited bandwidth of the first amplifier 22 prevents the output of the amplifier 22 from saturation when the telecoil 26 is exposed to high energy wide frequency spectrum electromagnetical signals.

Figure 3:
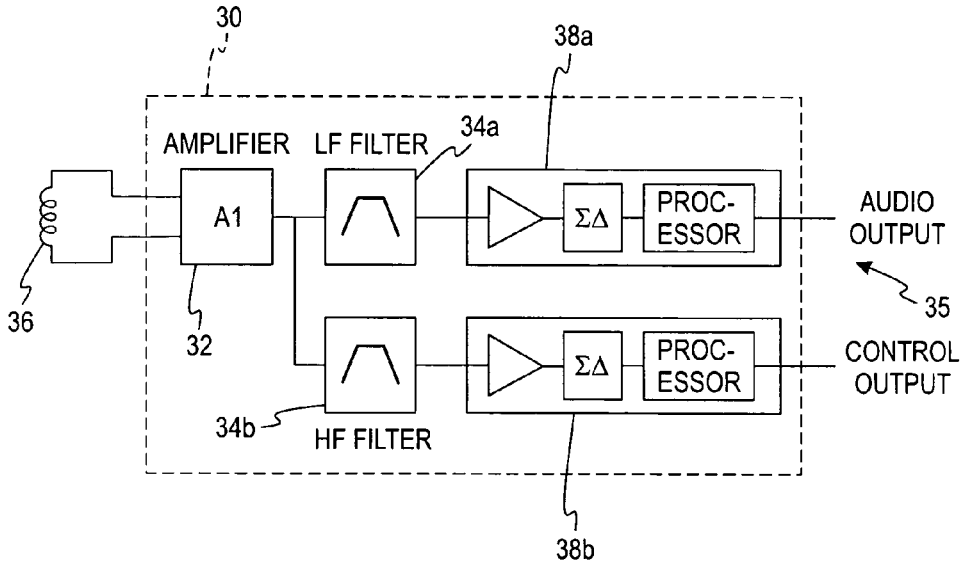
FIG. 3 is a schematic of an integrated amplified telecoil system in accordance with another embodiment of the invention.

The amplified telecoil system 25 of FIG. 2 can be implemented with one or more parallel signal processing paths (i.e., two, three, or more paths with associated filters and/or amplifiers) to simultaneously process several different types and/or frequency ranges of signals. As an example, FIG. 3 shows an amplified telecoil system 35 with two signal paths within the integrated telecoil amplifier 30. A single input amplifier 32 processes wide-band frequency spectrum received by the pickup coil 36 and sends the signals to the LF filter 34*a* and the HF filter 34*b*. The LF filter 34*a* is dedicated to processing signals in the audio frequency range (20 Hz to 10 kHz) and the HF filter 34*b* is dedicated to processing signals out of the audio band, further referred to as "control band" signals (e.g., modulated audio or control signals), on a second path. The LF- and HF-filters 34*a*, 34*b* perform the spectrum separation of the received signal into the two different signal paths. The LF filter 34*a* attenuates all signals out of the audio signal band (e.g., 20 Hz to 10 kHz). The HF filter 34*b* has a high-pass or band-pass frequency response and attenuates all signals outside of the control signal band (e.g., 30 kHz to 300 kHz). Amplifier/processors 38*a* and 38*b* follow the LF filter 34*a* and the HF filter 34*b*, respectively, to further process the signal (e.g., demodulation, decoding, modulation, encoding).

The control signal band associated with the HF filter 34*b* may contain various modulated signals which can be used, for example, for programming or controlling the hearing aid. To increase the sensitivity of the telecoil at the HF programming/remote control frequency, a capacitor can be connected in parallel to the telecoil to obtain a (parallel) resonance at the desired HF carrier frequency. In addition, the control band received by the HF filter 34*b* can also contain modulated audio signals, such as those sent from modulated loop systems.

The LF filter 34*a* may feature at least a $1^{st}$ order low-pass response and can be modified to be a band-pass and/or higher order response. Likewise, the HF filter 34*b* may feature at least a $1^{st}$ order high-pass response and can be modified to be a bandpass and/or higher order response. The filters 34*a*, 34*b* can be realized by continuous time or sampled data circuitry.

Figure 4:
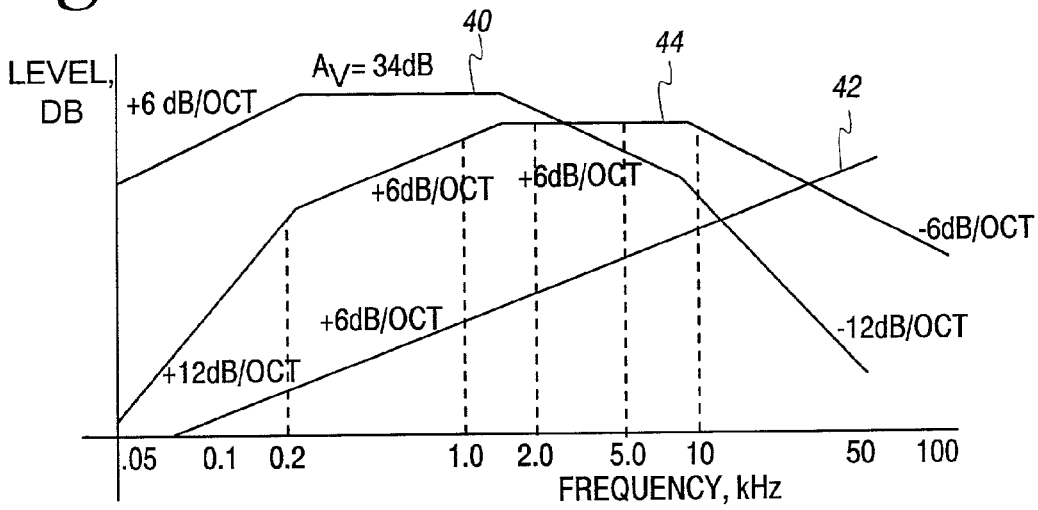
FIG. 4 is a family of frequency response curves showing a response of a telecoil, an amplifier, and an integrated amplified telecoil.

FIG. 4 illustrates one example of the frequency response curves of the integrated telecoil amplifier 20, the telecoil 26, and the amplified telecoil system 25. The typical frequency response in the audio frequency range (20 Hz to 10 kHz) of the amplifier 20 is illustrated by a curve 40. The frequency response of the telecoil 26 connected to the amplifier is shown by a curve 42. The frequency response of the amplified telecoil system 25 is shown by a curve 44. An integrated amplified telecoil system with telecoil and integrated telecoil amplifier, having one LF signal path providing a single audio analog output, was implemented, prototyped, and tested. The implemented integrated telecoil amplifier 20 features a typical gain of 34 dB, high-pass frequency roll-off at about 0.19 kHz, first low-pass roll-off at about 1.7 kHz, and second low-pass roll-off at about 20 kHz.

The amplifiers 22, 28, 32, 38*a*, 38*b* may contain additional filters and employ non-linear signal processing (e.g., compression, companding) functions. Further, the amplifiers 22, 28, 32, 38*a*, 38*b* can be organized in a multi-stage fashion with internal filters which set their individual bandwidths. Also, the amplifiers 22, 28, 32, 38*a*, 38*b* and filters 24, 34*a*, 34*b* can be tunable (e.g., gain, frequency shape, etc.). This tuning can be externally programmable or controlled by the hearing aid during its operation (adaptive tuning) or programming mode.

Figure 5:
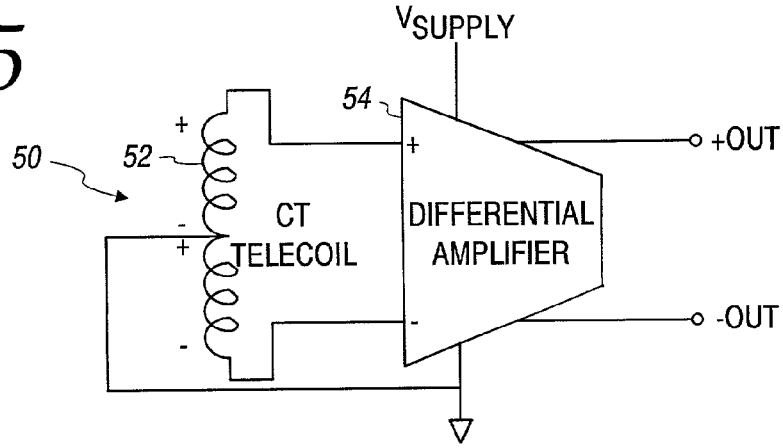
FIG. 5 illustrates another embodiment of the present invention having a center-tapped telecoil with its output being received by a differential amplifier.

FIG. 5 illustrates an embodiment of an integrated telecoil amplifier 50 having a center-tapped telecoil 52 with two outputs that are provided to a differential amplifier 54. The center tap of the center-tapped telecoil 52 is connected to the ground of the differential amplifier. The input power for the differential amplifier 54 is provided by a voltage source, $V_{supply}$. The combination of the center-tapped telecoil 52 and the differential amplifier 54 can be used in place of the telecoil and amplifiers in FIGS. 2 and 3. FIG. 5 provides an example of a balanced connection (i.e., a differential connection) between the telecoil 52 and the differential amplifier 54. Similarly, the connections between the other components in FIGS. 2 and 3 can be balanced or single-ended (e.g., between the amplifier and the LF/HF filters, between the filters and the buffers/amplifiers/processors, or between the buffer/amplifier/processor to the outside world). One of the benefits of using the center-tapped telecoil 52 of FIG. 5 is that it helps to reduce the effects of electromagnetic interference on the integrated telecoil amplifier 50.

Figure 6:
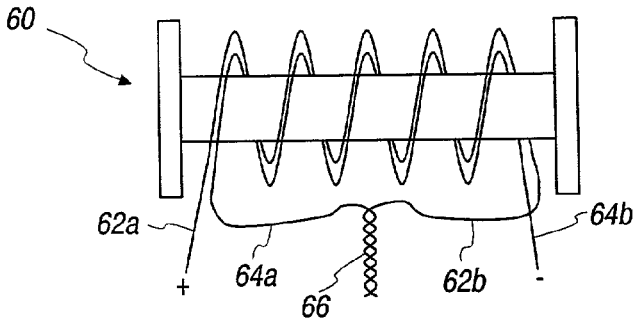
FIG. 6 illustrates one example of the center-tapped telecoil for use in the embodiment of FIG. 5

FIG. 6 illustrates a center-tapped telecoil 60 that is useful for the embodiment of FIG. 5. The center-tapped telecoil 60 includes a first wire 62 and a second wire 64 that are wrapped entirely around the core. The first end 62*a* of the first wire 62 is free, and a second end 62*b* meets with the first end 64*a* of the second wire 64 at a center tap 66. Because the center tap 66 is grounded, a first signal is produced between the first end 62*a* of the first wire 62 and the center tap 66, while a second signal is produced between the center tap 66 and the second end 64*b* of the second wire 64. These first and second signals are subtracted in the differential amplifier.

Figure 7:
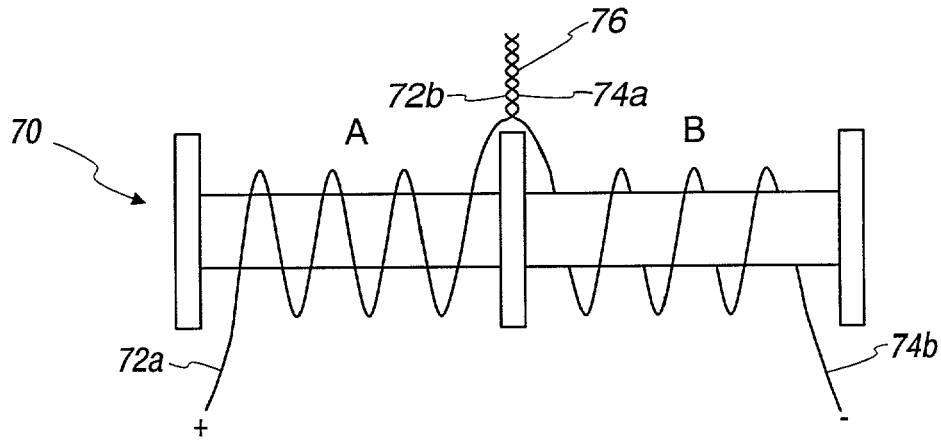
FIG. 7 illustrates another example of a center-tapped telecoil for use in the embodiment of FIG. 5.

FIG. 7 illustrates an alternative center-tapped telecoil 70 having two wires 72 and 74, each of which is wound around a corresponding portion of the core. The core may include a center flange, as shown, to divide the core into two segments, but the center flange may be lacking, as well. The second end 72*b* of the first wire 72 meets the first end 74*a* of the second wire 74 at a center tap 76. Because the center tap 76 is grounded, a first signal is produced between the first end 72*a* of the first wire 72 and the center tap 76, while a second signal is produced between the center tap 76 and the second end 74*b* of the second wire 74. As stated before with respect to FIG. 6, the center-tapped telecoil 70 is useful for the configuration of FIG. 5.

In any of the telecoil configurations described above with respect to FIGS. 1–7, one or more loops of the telecoil winding may be short-circuited to obtain an extra change in frequency response. A short-circuiting in a loop of the winding of the telecoil increases the parasitic capacitance and reduces the resonance frequency of the coil. These short circuits are made during the winding of the telecoil.

Figure 8:
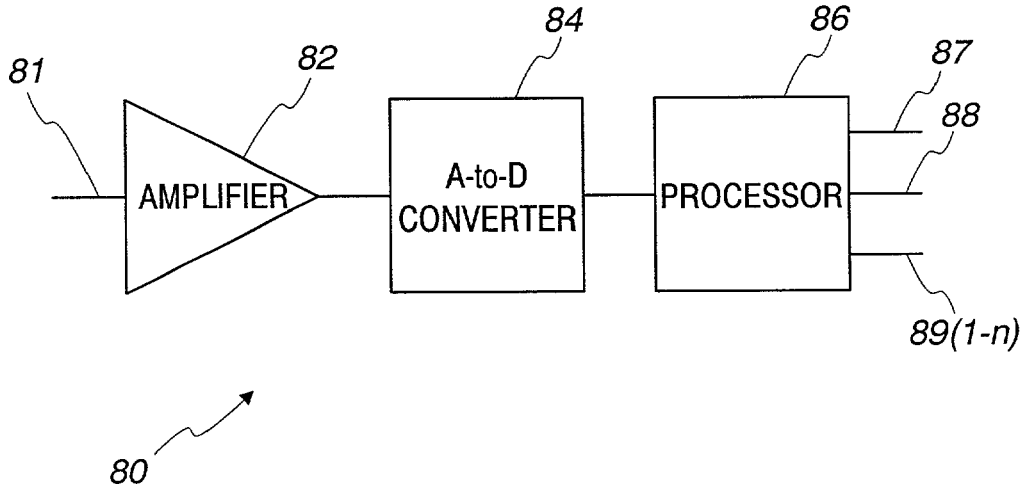
FIG. 8 illustrates in block diagram from another configuration of the present invention.

FIG. 8 illustrates an alternative embodiment of an integrated telecoil amplifier 80. In this embodiment, the telecoil signal 81 sends its output signal to an amplifier 82. The amplified output from the amplifier 82 is then sent to a fast analog-to-digital converter 84 that operates at a rate which gathers all high-frequency signals (e.g., about 1 MHz, although higher or lower rates are possible). The converter 84 converts the complete range of analog signals to a digital signal. The digital signal is then processed in a processor 86 and split into several signals 87, 88, 89, which represent the signals that were received by the telecoil. These signals can be analog and/or digital and can contain, e.g., audio, control, and/or programming data. The processing provided by the processor 86 can perform various functions, e.g., filtering, decoding, demodulation, algorithms, etc. The processor 86 is a fixed and/or programmable electronic circuit which may contain memory.

The telecoil and integrated circuit(s) of the present invention can be packaged in various ways, while still achieving the primary objectives of the present invention. For example, the lead wires of the telecoil are soldered to pads on a hybrid that already contains the integrated circuit(s). Other wires that make the connection between the telecoil/hybrid and other components are connected to other pads on the hybrid. The hybrid and telecoil are glued together. This entire assembly is partially or entirely encapsulated by placing potting material over it or dipping it into encapsulating material. Other types of workable packaging techniques are disclosed in International Publication No. WO 01/52598, entitled "Packaging And RF Shielding For Telecoils" which is assigned to the assignee of the present application, and is incorporated herein by reference in its entirety.

The present invention has a number of advantages. The frequency response of the amplified telecoil system is independent of telecoil parameters in the audio frequency range (e.g., 20 Hz to 10 kHz). Therefore, different types of telecoils can be used without affecting the frequency response of the amplified telecoil system. Further, the amplified telecoil system can be extended to receive and process signals out of the audio band, such as modulated audio signals, those that are used to control the operation of the hearing aid and those that program the hearing aid. The amplifier/processors 38*a*, 38*b* may contain microcontrollers, which can also be used to provide one or any combination of the following functions: self test, storage of setting (memory), initialization, adjusting gain and frequency response of the amplified telecoil, communication with outside (via coil or electrical audio or control outputs), and chip identification (serial number, manufacturer, date of fabrication, device type).

The above system may be varied in a number of ways without departing from the invention, including, but not limited to, one or more of the following. For example, the integrated telecoil amplifier can contain demodulation circuitry to process or decode received HF signals. The integrated telecoil amplifier can be programmable and/or controllable by electromagnetic signal or by some other form of interface. The integrated telecoil amplifier can provide analog or modulated audio output (for example, but not limited to, time discrete analog signal, digital audio, digital bit stream, I2S or other digital format) or both.

The integrated telecoil amplifier can provide analog or digital control output for a hearing aid, or both. The integrated telecoil amplifier can contain additional built-in analog or digital signal processing and/or integrated class-D amplifier(s) for hearing aid applications. The integrated telecoil amplifier can contain an integrated sigma-delta modulator to perform analog-to-digital conversion, as it is known to those skilled in the art, to provide digital output in the audio and/or control frequency bands. The integrated telecoil amplifier can contain a reference clock generator (autonomous or with an external frequency selective device) for a hearing aid.

All of the above-mentioned modifications lead to a higher level of integration of the functional blocks, which leads to better performance, increased miniaturization in the hearing aids, and higher comfort to the user.

The terms "telecoil" and "pickup coil" are used simultaneously herein with the synonym "induction pickup coil" as it is defined in IEC (International Electrotechnical Commission, 1 rue de Varembe, Geneva, CH) Publication 118 and 126. The term "audio frequency" signal refers to audio frequency signals in the audible range received by the induction pickup coil.

While the present invention has been described with reference to one or more particular embodiments, those skilled in the art will recognize that many changes may be made thereto without departing from the spirit and scope of the present invention. Each of these embodiments, and obvious variations thereof, is contemplated as falling within the spirit and scope of the claimed invention, which is set forth in the following claims.

What is claimed is:

1. An integrated amplified telecoil system, comprising:

a telecoil for producing an electrical output signal in response to electromagnetic radiation, said telecoil having an inductance and a resistance;

a first voltage amplifier receiving said electrical output signal and having a first amplifier output producing a first amplified signal, said first voltage amplifier having a high input impedance; and a first filter having a selected pass band in an audio frequency range integrated into an integrated circuit with said first voltage amplifier, said first filter coupled to said first amplifier output for receiving said first amplified signal and having a first filter output producing a first filtered signal, said first filter setting the frequency response of said integrated telecoil system, wherein said frequency response of said integrated telecoil system is independent of said inductance and said resistance of said telecoil.

2. The system of claim 1, further including a second amplifier integrated onto said integrated circuit with said first amplifier and said first filter, said second amplifier receiving said first filter signal and producing a second amplified output signal.

3. The system of claim 2, wherein said second amplifier is a signal processor.

4. The system of claim 1, further including a second filter on said integrated circuit and having a pass band different from said selected pass band of said first filter, said second filter receiving said first amplified signal and producing a second filtered signal.

5. The system of claim 4, further including a third amplifier for receiving said second filtered signal and producing a third amplified output signal.

6. The system of claim 5, wherein said third amplifier is realized as a signal processor.

7. The system of claim 1, wherein said telecoil is a center-tapped telecoil for producing two electrical output signals received by said first voltage amplifier.

8. The integrated amplified telecoil system of claim 1, wherein said telecoil and said integrated circuit are dimensioned to fit within a hearing aid.

9. A method of operating a listening device, comprising:

converting in a telecoil electromagnetic radiation to electrical signals;

providing said electrical signals to a high impedance input of a voltage amplifier;

amplifying in said voltage amplifier said electrical signals to produce first amplified signals; and filtering said first amplified signals in an audio frequency range to produce first filtered signals, wherein said amplifying and said filtering are performed on a single integrated circuit and wherein said filtering includes setting the frequency response of said telecoil in said audio frequency range, said frequency response being independent of the inductance and the resistance of said telecoil.

10. The method of claim 9, further including amplifying, on said single integrated circuit, said first filtered signals.

11. The method of claim 10, wherein said amplifying said first filtered signals includes processing said first filtered signals.

12. The method of claim 9, further including filtering, on said single integrated circuit, said first amplified signals with a pass band different from the pass band of said first filtering to produce second filtered signals.

13. The method of claim 12, further including amplifying, on said single integrated circuit, said second filtered signals.

14. The method of claim 13, wherein said amplifying said second filtered signals includes processing said second filtered signals.

15. The method of claim 9, wherein said converting is performed by a center-tapped telecoil.

16. A telecoil system for a listening device, comprising:

a center-tapped telecoil for producing at least two electrical output signals in response to being exposed to an electromagnetic field; and an integrated circuit receiving said electrical output signals, said integrated circuit including a voltage amplifier providing amplified electrical output signals and a filter for passing selected signals from said amplified electrical output signals, said selected signals being in a range from about 20 Hz to about 10 kHz, said integrated circuit further differentially processing said at least two electrical output signals, wherein said voltage amplifier has a high input impedance, the frequency response of said telecoil system being independent of the inductance and the resistance of said center-tapped telecoil.

17. The telecoil system of claim 16, wherein said telecoil is a center-tapped telecoil producing two electrical signals to be differentially processed by said integrated circuit.

18. A telecoil system for a hearing aid, comprising:

a telecoil for producing electrical output signals in response to being exposed to an electromagnetic field, said electrical output signals including an audio frequency signal in an audio frequency range and a non-audio frequency signal; and an integrated circuit having an amplifier circuit for amplifying said electrical output signal, a first filter for passing said audio frequency signal, and a second filter for passing said non-audio frequency signal, said amplifier circuit including a voltage amplifier, the frequency response of said telecoil system in said audio frequency range being independent of the inductance and the resistance of said telecoil, said first filter setting said frequency response of said telecoil system in said audio frequency range.

19. The telecoil system of claim 18, wherein said telecoil and said amplifier are coupled differentially.

20. The telecoil system of claim 18, wherein said telecoil and said amplifier are coupled in a single-ended fashion.

21. The telecoil system of claim 18, further including electrostatic discharge protection circuitry.

22. The telecoil system of claim 18, further including electromagnetic interference protection circuitry.

23. The telecoil system of claim 18, further including an analog-to-digital converter for providing a digital output of said audio frequency signal.

24. The telecoil system of claim 18, further including an analog-to-digital converter for providing a digital output of said non-audio frequency signal.

25. The telecoil system of claim 18, wherein said amplifier circuit includes a microcontroller for processing said non-audio frequency signal, said microcontroller providing functions for the operation of said hearing aid in response to said non-audio frequency signal.

26. The telecoil system of claim 18, further including a capacitor connected in parallel with said telecoil for increasing the sensitivity of the telecoil to the non-audio frequency signal.

27. The telecoil system of claim 18, wherein said telecoil is a center-tapped telecoil producing two electrical signals to be differentially processed by said integrated circuit.

28. A method of operating a listening device, comprising:

converting electromagnetic radiation to an analog electrical signal with a telecoil;

receiving said analog electrical signal in an integrated circuit having a voltage amplifier;

amplifying, in said voltage amplifier, said analog electrical signal to develop an amplified analog signal;

converting, in said integrated circuit, said amplified analog signal to a digital signal;

processing, in said integrated circuit, said digital signal into at least two digital outputs, one of said at least two digital outputs being an audio frequency band output, another of said at least two digital outputs being a control band frequency output representative of a frequency above the audio frequency range; and operating said listening device in a manner corresponding to said control band frequency output.

29. The method of claim 28, wherein said converting is by an analog-to-digital converter operating at a high rate to gather high-frequency signals.

30. The method of claim 29, wherein said rate is about 1 MHz.

31. A telecoil system for a listening device, comprising:

a telecoil for producing electrical output signals in response to being exposed to an electromagnetic field, said electrical output signals including an audio frequency signal and a non-audio frequency signal, said telecoil having an inductance and a resistance; and a hybrid circuit including at least one integrated circuit placed on a common miniature device that fits within a hearing aid, said integrated circuit having a voltage amplifier for amplifying said electrical output signal and at least one filter for passing said audio frequency signal, said at least one filter setting the frequency response of said telecoil system, said frequency response being independent of said inductance and said resistance of said telecoil.

* * * * *